US008353069B1

(12) United States Patent
Miller

(10) Patent No.: US 8,353,069 B1
(45) Date of Patent: Jan. 15, 2013

(54) DEVICE FOR HEATING, COOLING AND EMITTING FRAGRANCE INTO BEDDING ON A BED

(76) Inventor: Anthony W. Miller, Cumberland, VA (US)

( * ) Notice: Subject to any disclaimer, the term of this patent is extended or adjusted under 35 U.S.C. 154(b) by 232 days.

(21) Appl. No.: 12/807,508

(22) Filed: Sep. 7, 2010

(51) Int. Cl.
*A47C 27/00* (2006.01)

(52) U.S. Cl. ..... 5/423; 5/421; 5/652.1; 5/652.2; 5/724

(58) Field of Classification Search ..... 5/421, 423, 5/652.1, 652.2, 714, 724, 726
See application file for complete search history.

(56) References Cited

U.S. PATENT DOCUMENTS

| | | | | |
|---|---|---|---|---|
| D26,527 | S | 1/1897 | Ralston | |
| 822,167 | A | 5/1906 | Vaughn | |
| 2,313,864 | A | 3/1943 | Crise | |
| 2,378,821 | A | 6/1945 | Bagnall | |
| 2,548,467 | A | 4/1951 | Crise | |
| 3,713,182 | A | 1/1973 | McNeal | |
| 4,777,802 | A * | 10/1988 | Feher | 62/3.3 |
| 5,652,987 | A * | 8/1997 | Fujita | 5/726 |
| 5,882,349 | A | 3/1999 | Wilkerson et al. | |
| 5,887,303 | A | 3/1999 | Raith | |
| 6,363,551 | B1 * | 4/2002 | Flores | 5/423 |
| 6,425,527 | B1 * | 7/2002 | Smole | 236/49.3 |
| 6,493,889 | B2 * | 12/2002 | Kocurek | 5/423 |
| 6,581,225 | B1 * | 6/2003 | Imai | 5/423 |
| 7,913,332 | B1 * | 3/2011 | Barnhart | 5/423 |
| 7,945,979 | B1 * | 5/2011 | Lin | 5/726 |
| 8,191,187 | B2 * | 6/2012 | Brykalski et al. | 5/423 |
| 2006/0101577 | A1 * | 5/2006 | Lussier | 5/423 |
| 2007/0033733 | A1 * | 2/2007 | Jen | 5/423 |
| 2008/0028536 | A1 * | 2/2008 | Hadden-Cook | 5/724 |
| 2010/0212089 | A1 * | 8/2010 | Kajiwara et al. | 5/423 |
| 2010/0235991 | A1 * | 9/2010 | Ward et al. | 5/423 |
| 2010/0287701 | A1 * | 11/2010 | Frias | 5/423 |
| 2010/0325796 | A1 * | 12/2010 | Lachenbruch et al. | 5/423 |
| 2011/0010850 | A1 * | 1/2011 | Frias | 5/423 |
| 2011/0035880 | A1 * | 2/2011 | Cole et al. | 5/423 |
| 2011/0067178 | A1 * | 3/2011 | Lee | 5/423 |
| 2011/0119826 | A1 * | 5/2011 | Marquette et al. | 5/423 |
| 2011/0271448 | A1 * | 11/2011 | Faridoon | 5/423 |
| 2011/0296611 | A1 * | 12/2011 | Marquette et al. | 5/423 |
| 2012/0017371 | A1 * | 1/2012 | Pollard | 5/423 |

FOREIGN PATENT DOCUMENTS

FR 2835164 A3 * 8/2003

* cited by examiner

*Primary Examiner* — Robert G Santos
*Assistant Examiner* — Brittany Wilson
(74) *Attorney, Agent, or Firm* — Richard L. Miller

(57) ABSTRACT

A device for heating, cooling and emitting fragrance into bedding on a mattress of a bed which comprises a vented bladder placed upon the mattress under the bedding of the bed. A mechanism is for producing forced air being hot/cool and scented. A flexible air hose extends between the vented bladder and the forced air producing mechanism, to carry the hot/cool and scented air from the forced air producing mechanism to the vented bladder and into the bedding.

5 Claims, 5 Drawing Sheets

DEVICE FOR HEATING, COOLING AND EMITTING FRAGRANCE INTO BEDDING ON A BED

BACKGROUND OF THE INVENTION

1. Field of the Invention

The present invention relates to a bed warmer, and more particularly, a device for heating, cooling and emitting fragrance into bedding on a bed.

2. Description of the Prior Art

Numerous innovations for bed warming devices have been provided in the prior art that will be described. Even though these innovations may be suitable for the specific individual purposes to which they address, however, they differ from the present invention.

A FIRST EXAMPLE, U.S. Patent Office Document No. D26,527, Issued on Jan. 12, 1897, to Ralston teaches a design for a bed-warmer substantially as herein shown and described.

A SECOND EXAMPLE, U.S. Patent Office Document No. 822,167, Issued on May 29, 1906, to Vaughn teaches a device for changing the temperature in beds comprising a casing having its bottom open and a small opening its top, a plug entirely closing the small opening, a motor-casing carried by the plug and extending into the main casing, a motor therein and a fan in the main casing connected to the motor-shaft.

A THIRD EXAMPLE, U.S. Patent Office Document No. 2,313,864, Issued on Mar. 16, 1943, to Crise teaches in an electric warming pad constructed with parallel pockets the method of installing a warming filament which consists of inserting hairpin loops of the filament into consecutive elongated pockets of the pad by means of a bodkin, anchoring the closed end of each hairpin loop and withdrawing the bodkin leaving a complete hairpin loop in each individual pocket.

A FOURTH EXAMPLE, U.S. Patent Office Document No. 2,378,821, Issued on Jun. 19, 1945, to Bagnall teaches a bed warmer comprising a blanket constructed with warp and woof, a number of flexible perforate tubes extending parallel to the warp, the tubes being woven into the blanket and means for directing heated air into the tubes.

A FIFTH EXAMPLE, U.S. Patent Office Document No. 2,548,467, Issued on Apr. 10, 1951, to Crise teaches a flexible, porous, electrically heated warming device comprising a sheet of porous fabric material, a continuous convoluted grid of electrical resistance wire, and a flexible outer covering of fusible dielectric material carried on the resistance wire and firmly uniting the same with the sheet, the fusible dielectric material being integrally thermoplastically joined to the sheet and being confined substantially to the regions of the resistance wire whereby to prevent impairment to the over-all porosity of the sheet.

A SIXTH EXAMPLE, U.S. Patent Office Document No. 3,713,182, Issued on Jan. 30, 1973, to McNeal teaches an apparatus for elevating bedclothes above a bed and for warming the air under the bedclothes. Two hollow, tubular rigid arms are vertically mounted on either side of a bed; one or more flexible, resilient lines span the free ends of the rigid arms to form a structure over which the bedclothes drape. The flexible lines are removable and adjustable. Under the bed is a small air blower with a heating unit. The air blower discharges heated air into the bed through the passages formed in the hollow, tubular rigid arms of the bedclothes elevator.

A SEVENTH EXAMPLE, U.S. Patent Office Document No. 5,882,349, Issued on Mar. 16, 1999, to Wilkerson et al. teaches in one preferred embodiment, a patient moisture control support surface coverlet to draw moisture from a patient reposed thereon, the coverlet including: an outer layer of an air-tight, water-vapor-permeable material; an inner layer of an air- and vapor-impermeable material underlying the outer layer and sealed to the lower surface of the outer layer to define therebetween a volume to underlie a substantial portion of the patient; apparatus to introduce a flow of air to at least a portion of the volume; and apparatus to permit the flow of air to exit at least a portion of the volume.

AN EIGHTH EXAMPLE, U.S. Patent Office Document No. 5,887,303, Issued on Mar. 30, 1999, to Raith teaches a bed warmer apparatus including box-like housing member that has a pair of elongated side walls with a pair of short side walls therebetween. The pair of elongated side walls and the pair of short side walls are interconnected to a top wall. The top wall has a cylindrical coupler extending therefrom and defining an opening in the top wall. The housing member is sized for positioning around an air vent and receiving air therein to pass through the cylindrical coupler. Also, a fluted nozzle with a first end and a second end is provided. Lastly, an elongated flexible hose is included and has a first hose end coupled with the coupler and a second hose end coupled with the first end of the fluted nozzle.

It is apparent now that numerous innovations for bed warming devices have been provided in the prior art that are adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a device for heating, cooling and emitting fragrance into bedding on a bed that avoids the disadvantages of the prior art.

ANOTHER OBJECT of the present invention is to provide a device for heating, cooling and emitting fragrance into bedding on a bed that is simple and inexpensive to manufacture.

STILL ANOTHER OBJECT of the present invention is to provide a device for heating, cooling and emitting fragrance into bedding on a bed that is simple to use.

BRIEFLY STATED, STILL YET ANOTHER OBJECT of the present invention is to provide a device for heating, cooling and emitting fragrance into bedding on a mattress of a bed which comprises a vented bladder placed upon the mattress under the bedding of the bed. A mechanism is for processing air by heating or cooling and scenting the air. A flexible air hose extends between the vented bladder and the forced air producing mechanism, to carry the hot or cool and scented air from the mechanism for processing the air to the vented bladder and into the bedding.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows.

A MARSHALING OF REFERENCE NUMERALS UTILIZED IN THE DRAWING

Figure 1:
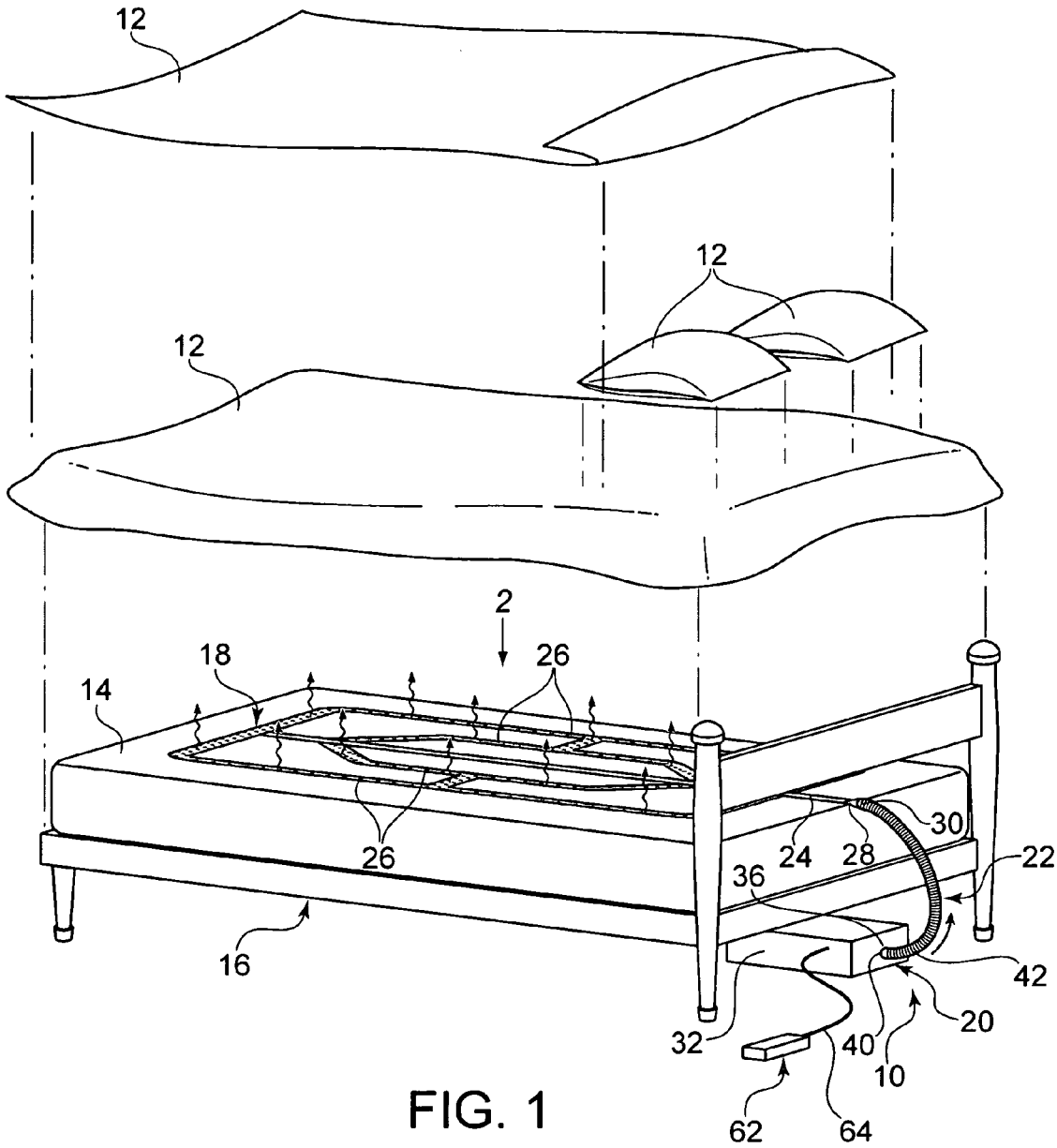
FIG. 1, is a diagrammatic exploded perspective view showing an embodiment of the present invention installed on a mattress of a bed.
Figure 3:
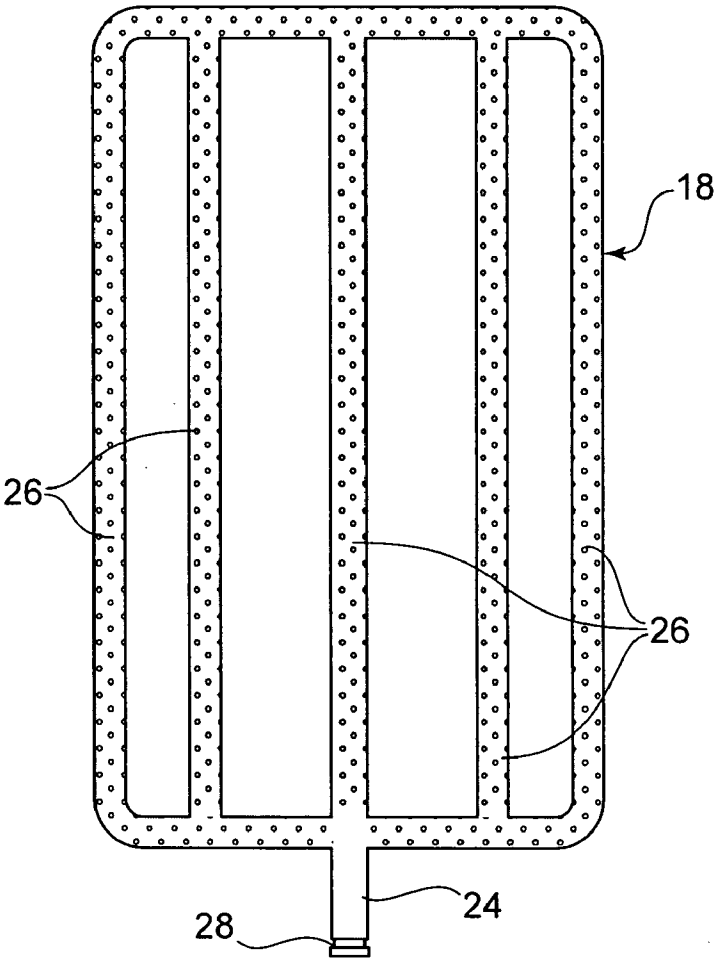
FIG. 3 is a diagrammatic top view similar to FIG. 2, showing a second configuration of the vented bladder per se.

10 device
12 bedding of bed 16
14 mattress of bed 16
16 bed
18 vented bladder of device 10
20 forced air producing mechanism of device 10
22 flexible air hose of device 10
24 inflatable tubular trunk of vented bladder 18
26 perforated branch of inflatable tubular trunk 24
28 coupler of vented bladder 18
30 first end of flexible air hose 22
32 housing of forced air producing mechanism 20
34 air inlet port of housing 32
36 air outlet port of housing 32
38 blower assembly of forced air producing mechanism 20
40 connector of forced air producing mechanism 20
42 second end of flexible air hose 22
44 air filter of blower assembly 38
46 electric fan of blower assembly 38
48 heat exchanger of blower assembly 38
50 control circuit of forced air producing mechanism 20
52 reversible heat pump of forced air producing mechanism
54 container of forced air producing mechanism 20
56 scent source in container 54
158 scent venturi of forced air producing mechanism 20
60 solenoid valve of forced air producing mechanism 20
62 control unit of device 10
64 elongated wire of control unit 62
66 remote control wireless receiver of control unit 62
68 elongated wire of remote control wireless receiver 66
70 remote control wireless transmitter of control unit 62
72 optional control panel of control unit 62
74 on switch of control unit 62
76 off switch of control unit 62
78 timer of control unit 62
79 time display of timer 78
80 on hour button of timer 78
82 on minute button of timer 78
84 off hour button of timer 78
86 off minute button of timer 78
88 hot and cold lever of control unit 62
90 high and low lever of control unit 62
92 scent lever of control unit 62

DETAILED DESCRIPTION OF THE PREFERRED EMBODIMENT

Figure 2:
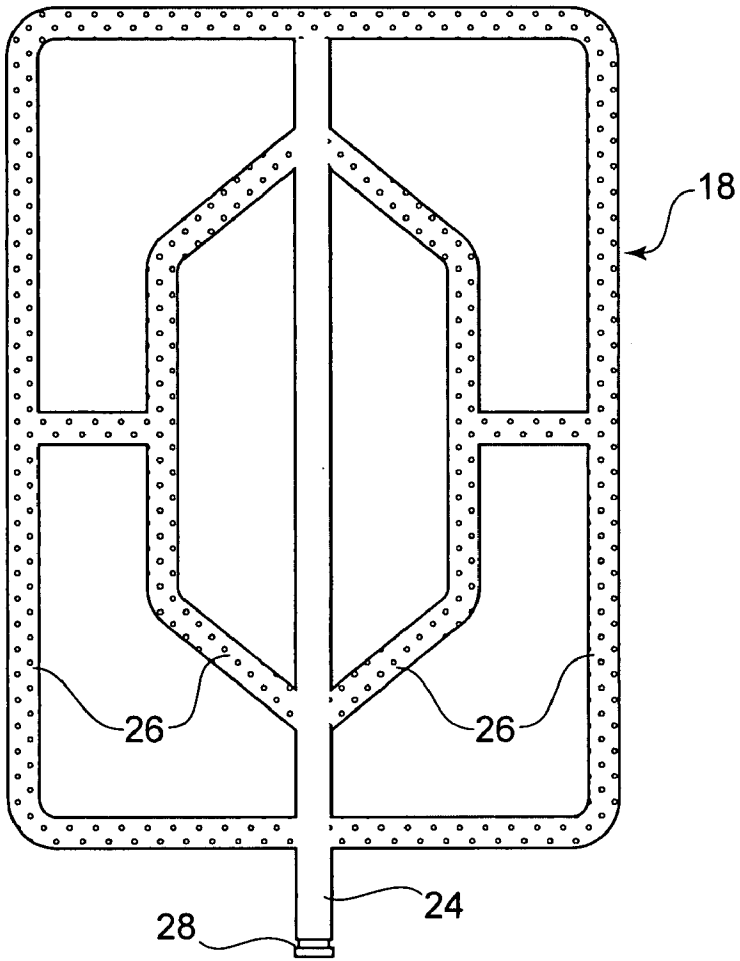
FIG. 2 is a diagrammatic top view taken in the direction of arrow 2 in FIG. 1, showing a first configuration of the vented bladder per se.
Figure 4:
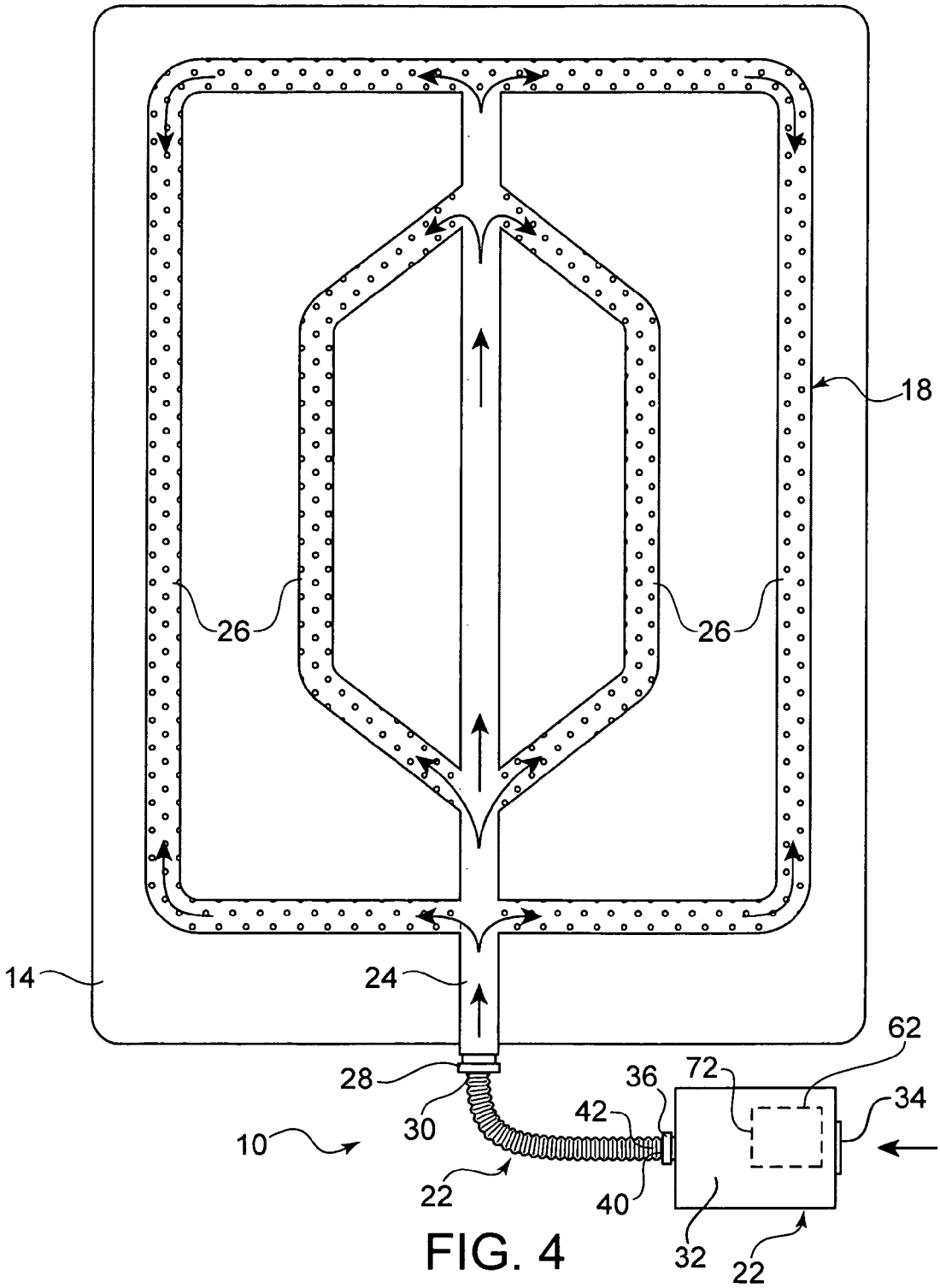
FIG. 4 is a diagrammatic top view of the present invention, showing a third configuration of the vented bladder placed upon the mattress of the bed.

Referring now to the figures, in which like numerals indicate like parts, and particularly to FIGS. 1 through 6, which are a diagrammatic exploded perspective view showing an embodiment of the present invention installed on a mattress of a bed; a diagrammatic top view taken in the direction of arrow 2 in FIG. 1, showing a first configuration of the vented bladder per se; a diagrammatic top view similar to FIG. 2, showing a second configuration of the vented bladder per se; a diagrammatic top view of the present invention, showing a third configuration of the vented bladder placed upon the mattress of the bed; a block diagram showing the interconnection and cooperation among the components within the housing of the present invention; and a diagrammatic perspective view of the control unit for operating and changing mode parameters of the present invention, and as such, will be discussed with reference thereto.

The present invention is a device 10 for heating, cooling and emitting fragrance into bedding 12 on a mattress 14 of a bed 16 which comprises a vented bladder 18 placed upon the mattress 14 under the bedding 12 of the bed 16. A mechanism 20 is for forcing air into the bladder which may be cooled or heated and scented. A flexible air hose 22 extends between the vented bladder 18 and the air forcing mechanism 20, to carry the hot/cool and scented air from the forced air producing mechanism 20 to the vented bladder 18 and into the bedding 12.

The vented bladder 18 comprises an inflatable tubular trunk 24 having a plurality of perforated branches 26 extending therefrom. A coupler 28 on free end of the inflatable tubular trunk 24 connects to a first end 30 of the flexible air hose 22.

Figure 5:
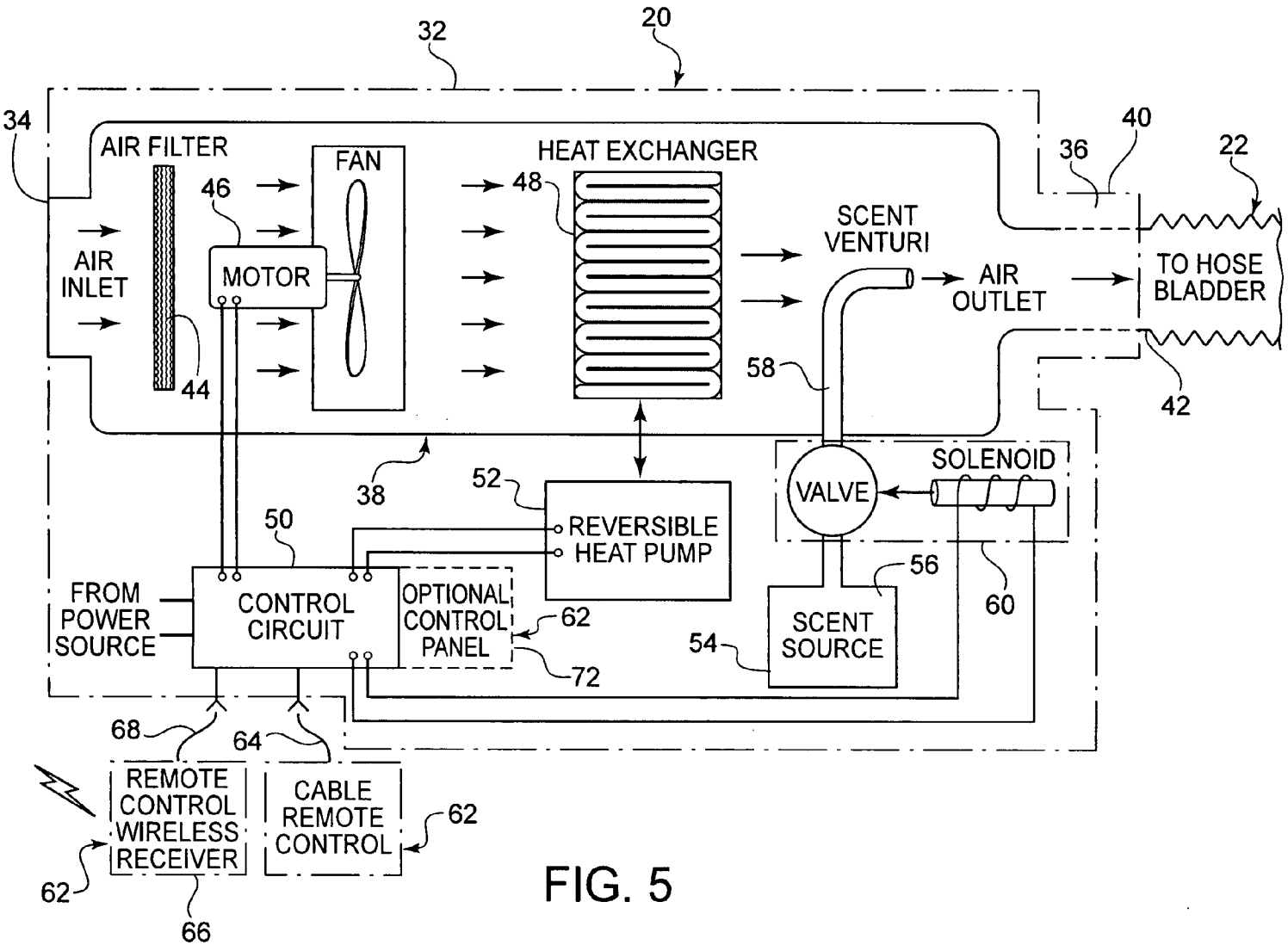
FIG. 5 is a block diagram showing the interconnection and cooperation among the components within the housing of the present invention.

As best seen in FIG. 5, the forced air producing mechanism 20 comprises a housing 32 having an air inlet port 34 and an air outlet port 36. A blower assembly 38 extends between the air inlet port 24 and the air outlet port 36 of the housing 32. A connector 40 on the air outlet port 36 of the housing 32 connects to a second end 42 of the flexible air hose 22.

The blower assembly 38 comprises an air filter 44 adjacent to the air inlet port 34 of the housing 32. An electric fan 46 is in front of the air filter 44. A heat exchanger 48 is between the electric fan 46 and the air outlet port 36 of the housing 32, so that heat exchanger is in the forced air stream of the fan for forcing air through said bladder. A control circuit 50 is electrically connected between a power source and the electric fan 46 in the blower assembly 38. A reversible heat pump 52 is electrically connected between the control circuit 50 and the heat exchanger 48 in the blower assembly 38 so that air flowing there through may accordingly be heated or cooled to temperatures respectively above or below the surrounding ambient air temperatures.

A container 54 in the housing 32 is for holding a scent source 56 therein. A scent venturi 58 extends from the container 54 into the blower assembly 38 between the heat exchanger 48 and the air outlet port 36 of the housing 32. A solenoid valve 60 in the scent venturi 58 is electrically connected to the control circuit 50.

The device 10 further comprises a control unit 62 electrically connected to the control circuit 50 for operating and changing mode parameters thereof. The control unit 62 comprises an elongated wire 64 that plugs into the control circuit 50 thereby making the control unit 62 remote therefrom. The control unit 62 can also consist of a remote control wireless receiver 66 having an elongated wire 68 that plugs into the control circuit 50. A remote control wireless transmitter 70 sends various control signals to the remote control wireless receiver 66. The control unit 62 can also consist of an optional control panel 72 mounted directly onto the housing 32 of the forced air producing mechanism 20.

Figure 6:
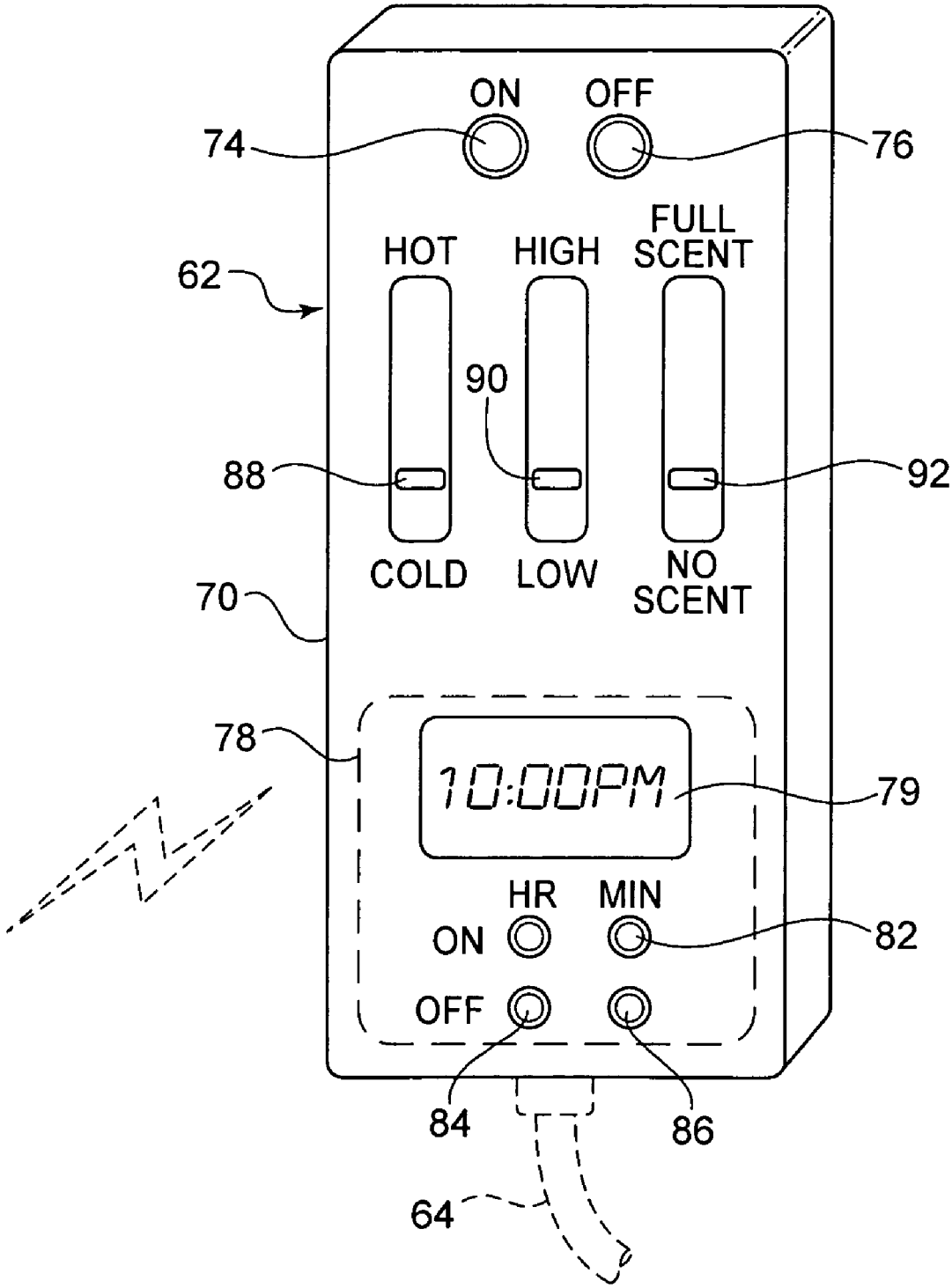
FIG. 6 is a diagrammatic perspective view of the control unit for operating and changing mode parameters of the present invention.

The control unit 62, as shown in FIG. 6, contains an on switch 74 and an off switch 76. A timer 78 has a time display 79, an on hour button 80, an on minute button 82, an off hour button 84 and an off minute button 86. A hot and cold lever 88 controls the reversible heat pump 52. A high and low lever 90 controls the electric fan 46. A scent lever 92 controls the solenoid valve 60.

It will be understood that each of the elements described above, or two or more together, may also find a useful application in other types of constructions differing from the types described above.

While the invention has been illustrated and described as embodiments of a device for heating, cooling and emitting fragrance into bedding on a bed, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A device for heating, cooling and emitting fragrance into bedding on a mattress of a bed which comprises:

a) a vented bladder for placement upon the mattress under the bedding of the bed;

b) means for forcing processed air through said bladder;

c) a flexible air hose extending between said vented bladder and said means for forcing said processed air through said bladder to carry said processed air to said vented bladder and into the bedding, wherein said vented bladder comprises:

d) an inflatable tubular trunk having a plurality of perforated branches extending therefrom; and e) a coupler on free end of said inflatable tubular trunk which connects to a first end of said flexible air hose, wherein said means for forcing air through said bladder comprises:

f) a housing having an air inlet port and an air outlet port;

g) a blower assembly extending between said air inlet port and said air outlet port of said housing;

h) a connector on said air outlet port of said housing which connects to a second end of said flexible air hose, wherein said blower assembly comprises:

i) an air filter adjacent to said air inlet port of said housing;

j) an electric fan in front of said air filter;

k) a heat exchanger between said electric fan and said air outlet port of said housing, wherein said means for forcing air through said bladder further comprises:

l) a control circuit electrically connected between a power source and said electric fan in said blower assembly;

m) a reversible heat pump electrically connected between said control circuit and said heat exchanger in said blower assembly, wherein said means for forcing air through said bladder further comprises:

n) a container in said housing for holding a scent source therein;

o) a scent venturi extending from said container into said blower assembly between said heat exchanger and said air outlet port of said housing; and p) a solenoid valve in said scent venturi electrically connected to said control circuit.

2. The device as recited in claim 1, further comprising a control unit electrically connected to said control circuit for operating and changing mode parameters thereof.

3. The device as recited in claim 2, wherein said control unit comprises an elongated wire that plugs into said control circuit thereby making said control unit remote therefrom.

4. The device as recited in claim 2, wherein said control unit comprises:

a) a remote control wireless receiver having an elongated wire that plugs into said control circuit; and b) a remote control wireless transmitter which sends various control signals to said remote control wireless receiver.

5. The device as recited in claim 2, wherein said control unit comprises an optional control panel mounted directly onto said housing of said forced air producing means.

* * * * *